US008534210B2

(12) United States Patent
Luque

(10) Patent No.: US 8,534,210 B2
(45) Date of Patent: Sep. 17, 2013

(54) GATEWAY PLATE DEVICE FOR A SLOTTED MAST OR SPAR HAVING A CHANNEL

(76) Inventor: Tom Luque, Camas, WA (US)

( * ) Notice: Subject to any disclaimer, the term of this patent is extended or adjusted under 35 U.S.C. 154(b) by 305 days.

(21) Appl. No.: 13/162,474

(22) Filed: Jun. 16, 2011

(65) Prior Publication Data

US 2011/0308440 A1 Dec. 22, 2011

Related U.S. Application Data

(60) Provisional application No. 61/397,753, filed on Jun. 17, 2010.

(51) Int. Cl.
*B63H 9/08* (2006.01)
*B63H 9/10* (2006.01)

(52) U.S. Cl.
USPC ..... 114/102.15; 114/90; 114/108; 114/112

(58) Field of Classification Search
USPC . 114/89–101, 102.1, 102.12, 102.15–102.21, 114/104–115; 116/173, 174; 174/45 R
See application file for complete search history.

(56) References Cited

U.S. PATENT DOCUMENTS 2,242,319 A * 5/1941 Myers ..... 114/112
3,835,804 A * 9/1974 Jackson ..... 114/107
5,044,294 A 9/1991 Kronich et al.
5,546,881 A 8/1996 Frederiksen
5,641,939 A * 6/1997 Tourigny ..... 174/45 R
6,766,753 B2 * 7/2004 Pierson ..... 114/106

OTHER PUBLICATIONS

Snap-Gate: Internet website mastgates.com or snap-gate.com.*
Selden Mast Slide: Internet website sailrite.com/Selden-Mast-Slide-Plastic-5-8.*
Track Stop: Internet website sailrite.com/Sail-Track-Stop-Round.*

* cited by examiner

*Primary Examiner* — Ajay Vasudeva
(74) *Attorney, Agent, or Firm* — Peter A Haas Esquire LLC

(57) ABSTRACT

An improved system for rigging a sail to a spar consists of a slot and a gateway plate. The slot is disposed on the spar to selectively enable the sail slugs to engage an internal channel. The gateway plate is adapted to selectively cover the slot and can be removed so the slugs can be inserted to or removed from the channel. The gateway plate consists of a plate body having a first and second oppositely disposed plate-hole, the plate holes having a predetermined alignment with receiving-holes on the spar, the gateway plate further includes a channel-engaging edge, an oppositely disposed handle end, and a predetermined length of elastic cord, which couples to the spar and provides positive engagement of the gateway plate against the spar when in the closed position. The gateway plate can be mounted internally or externally relative to the spar channel.

5 Claims, 14 Drawing Sheets

FIG. 16
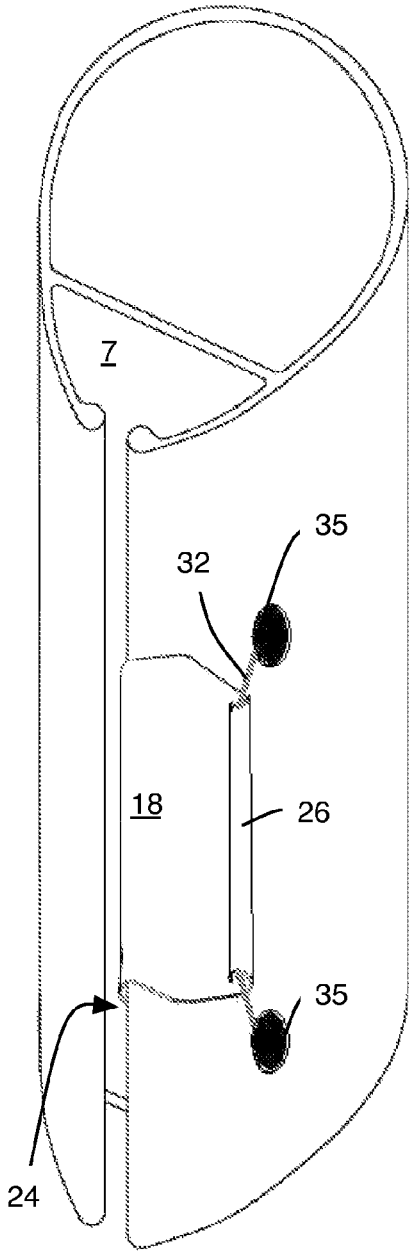
FIG. 17
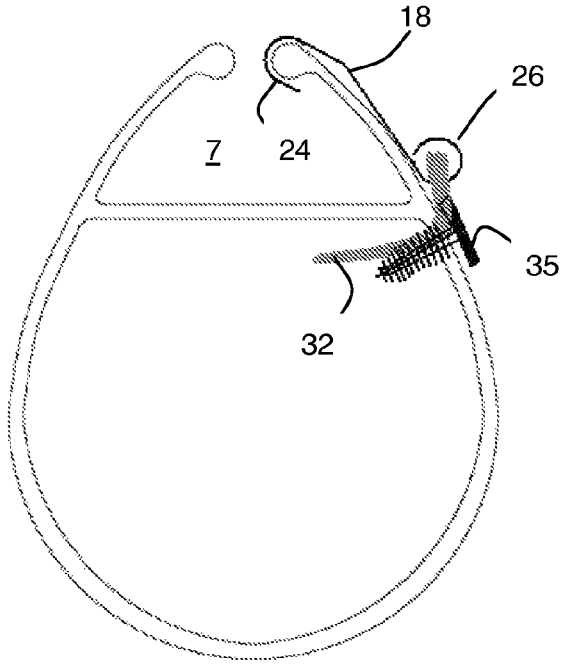
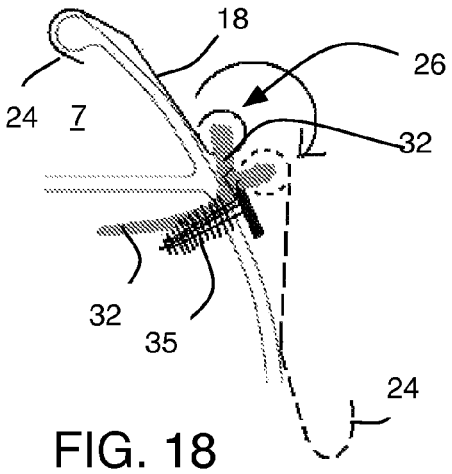
FIG. 18

GATEWAY PLATE DEVICE FOR A SLOTTED MAST OR SPAR HAVING A CHANNEL

PRIORITY CLAIM

The present application claims benefit under 35 USC Section 119(e) of U.S. Provisional Patent Application Ser. No. 61/397,753 filed on Jun. 17, 2010: The present application is based on and claims priority from this application and the disclosure of which is hereby expressly incorporated herein by reference.

BACKGROUND

This invention relates to a gateway plate or cover for an inward slot on a spar, and more particularly an inward slot as found commonly on a mast, boom, or beam (generally and collectively, a 'spar') on sailing vessels having an aperture for loading and unloading cars, carriers (collectively 'slugs') and similar such slide member as would be used on the leading edge on a mainsail, for example.

Masts for sail vessels such as sailboats have a rearward facing slot or channel for supporting a luff or leading edge of a mainsail. For example, the luff of the sail may be attached to a bolt-rope, and a circular channel having a restricted opening may be provided in the mast. The boltrope is introduced at an enlarged opening in the channel near the bottom of the mast, and the sail may be raised and lowered using a halyard attached to the head of the sail. In other arrangements, the luff may be secured to a plurality of spaced sail slugs (also may be called sail slides, lugs, or slide members, but for clarity are referred to herein as "sail slugs"): The sail slugs slide in the channel (also called a groove, or track, or slot but for clarity referred to herein as a "channel") and are shaped to correspond to the shape of the interior channel, such as t-shaped or U-shaped, for example (refer to common channels known in the art as FIG. 1 depicts).

As discussed by Frederiksen in U.S. Pat. No. 5,546,881 issued on 1996-08-20, track systems are generally known in this art. Such common systems include an essentially U-shaped track is essentially that is adapted for mounting on the mast with the cavity facing the groove. The fastening means are screws being inserted through transverse openings in the track. For fastening the track onto the mast, each individual slide member is to be slid in the groove, until its threaded hole is aligned with the corresponding transverse opening in the track, whereafter a screw is inserted through the transverse opening to engage the threaded hole in the slide member. One problem highlighted by Frederiksen with this common system is that it is a rather difficult and time-consuming operation, and it is particularly difficult to bring the screw into engagement with the threaded hole. Further, said system has the drawback that the slide member slides downwards, until it abuts the subjacent slide member, if a screw is unscrewed after the track has been mounted. It is not possible to mount this slide member again without loosening all of the remaining slide members that have been used to fasten the track to the mast. This operation is often very time-consuming, since slide members are sometimes used.

To overcome these known limitations, Frederiksen suggests a system and method for mounting tracks on an upright mast wherein the number of slide members corresponding to the number of transverse openings in the track are arranged in the groove, and a fastening means, such as a screw, is inserted through the lowermost transverse opening to engage the axial opening in the lowermost slide member. The row of slide members are then moved upwards by means of a tool, for instance a screwdriver inserted in between the track and the mast. Thus, when the lowermost slide member is aligned with the second lowermost opening, the outermost end of the protruding portion of the slide member falls into the recess in the track, when the track is slightly preloaded towards the mast. The preload may be provided by pressing lightly against the track with the hand or by tightening the lowermost screw. This procedure is continued in an upward direction, until all of the slide members engage the corresponding transverse openings in the track. For every fourth to eighth slide member, it may be advantageous to fasten a screw in order to control the track more easily.

Yet, despite such improvements this common chore remains problematic. And, in windy or adverse weather the task of raising a sail becomes more difficult and in certain instances can become unsafe. For example, each time the power of the wind catches a raised sail (or partially raised sail) there is the danger of the sail flogging and the jerking of the boat, which is compounded when the boat sits atop of a trailer during setup. And, the hazard of this task when done on the open water is even greater—thus, the current art requires at least one able-bodied sailor with two hands, or preferably, a pair of sailors with one loading the sail slugs in the slot and the second sailor maintaining force on the halyard.

The conventional teaching in the art instructs installing a mainsail on an aluminum-extruded mast by connecting the main halyard to the sail's head. Then, one hand (or one sailor) hoists the sail up slowly several inches until the sail's first top sail-slug aligns with the sail slot opening in the mast, and the other hand (or second sailor) will insert the sail-slug into the sail slot opening to engage the sail track slot. This hoisting and inserting continues with two hands (or two sailors) till the last sail-slug is up the sail track, then a slot-stop or other means is installed above the slot opening to block the track, thus preventing the sail-slugs from spilling out of the open sail slot when lowering sail before: launching; reefing; or docking.

One attempt to improve raising a main sail includes a slot-stop device that creates a no-slug zone. But, this results in a higher vertical profile distance between the boom and the sail head, thus impeding the viewing area for the helmsman, increasing wind resistance, and requiring more canvas for making a sail cover. Also, with the increased vertical profile caused by the no-slug zone, there is greater working distance between the reefing J-hook on the boom and the sail's luff reef cringle.

Further, current methods and devices sometimes result in a missed slug. This requires a time consuming lowering of the sail, removing each slug until the missed slug is re-fed and the raising procedure is repeated.

Also, during windy times, it is safer and quicker to load the sail downward toward the boom so the sail is never opened to the wind and many existing devices and methods do not adequately allow a sailor to load the sail in this manner.

Further limitations in the known art include, for systems that require screws, screws often fall overboard, it is hard to use a screwdriver while on water, mast and screws are different metals that cause electrolysis corrosion that eat away the threads and/or cause the screws to seize, and manipulation of known systems often require two hands.

Thus, there remains a need for a device and method that improves the art of sail-raising using an internal guide or track as is common in the art. Such an improved device and method should be able to be retrofitted to existing spars. Ideally, such a device would include a one-way gate-track cover or lid that can be installed in many existing aluminum extruded masts to resolve the above issues by being able to install sail-slugs downward toward the boom, so the sail is never caught opened to the wind and to be able to load missed slugs without removing other slugs.

SUMMARY OF THE INVENTION

The present invention improves over the current teaching in the art and provides a device and method that can be retrofitted to existing spars having an internal track. The device consists of a one-way gate-track, that arranges over a wide aperture on a spar (such apertures being well-known in the art to load sail slugs), the device is elastically secured behind, or alternatively over, a new slot opening or preexisting sail-slot opening in spar (such as a mast) for the purpose of slidably loading sail-slugs up into a sail-track without being able to spill back out, and to reclaim the full sliding range of the track, past the slot, which would be previously lost to a open sail-slot cut out.

The present invention enables a single sailor, using just one hand, to load a sail and this is particularly useful during windy times, because it is safer and quicker to load the sail downward toward the boom so the sail is never opened to the wind. Further, since the halyard is not required, both hands are free to quickly install the sail-slugs.

Another advantage of the present invention is the elimination of a "slot stop" device, which then enables the sail to slide down to a lower profile on the boom, which, for example, reduces wind resistance, provides a less obstructed view over the boom, enables easier reefing by permitting the J-hook to reach the sail cringle. J-hook reaches sail cringle for easier reefing.

Further, a great dockside benefit of the present invention includes moving the boom and sail above the gateway plate for more headroom height in the cockpit, or making a taller boom-tent shelter. Yet another added benefit is that a track-mounted boom can also snap through the one-way gateway plate for installing, and can be raised up passed the gateway plate to create greater walking or boom tent height when docked.

One object of the present invention is to provide a quick and safe sail-attaching apparatus, a "one-way gate-track, with non-interference bi-directional sliding", (herein called the gateway plate or apparatus).

In other embodiments, the gateway plate can be used in a horizontal or vertical spar for attaching curtains, to create space separation panels or window coverings.

Internal Mount

In a first preferred embodiment, the present invention includes a gateway plate that mounts inside a spar, resting on an interior surface of the channel provided by the spar. The gateway plate resists the slight outward pressure of a sail-slug foot against the gate, yet the gateway plate will hinge inward by elastic means thus allowing passage of the sail-slug foot into the sail track, and then self close (snap closed). The design of the gateway plate prevents the unintended removal of the sail slug from the track. To remove the sail-slug foot out of the sail track, the user will have to apply pressure to the gateway plate before the removal of a sail-slug from the track.

Additionally, the top and bottom of the gateway plate edges preferably sits behind the slot cutout in a manner to preferably cover the slot's top and bottom opening edge a little more.

Further, the gateway plate is preferably elastically-hinged attached halfway between the forward border edge of the sail-slot cutout, and the gate's forward edge will hinge on the inside port mast wall near the apex of the rear track wall.

External Mount

In a second preferred embodiment, the present invention includes a gateway plate that mounts exteriorly on the spar to cover an existing slot (or a slot can be cut into the spar to retrofit the present invention). The gateway plate resists the slight outward pressure of a sail-slug foot against the gate by means of the leading edge, which wraps around a portion of the spar at the slot opening and the elastic member provides positive tension to keep the gateway plate in position. To open, the leading lip edge must be moved forward and up by means of a handle portion. The design of the gateway plate prevents the unintended removal of the sail slug from the track.

In both the first and second preferred embodiment, and in other contemplated preferred embodiments, by changing the dimensional point of interference where the top and bottom borders of the slot edge and gateway plate edges create a pivot point, and in turn, affects the mechanical advantage holding strength. Increasing the notch length forward to decrease the width of the gateway plate edges will decrease the holding pressure.

In a preferred embodiment the gateway plate is made of forged aluminum, anodized for strength and to add a color, but in other embodiments, can be made out of wood, plastic, stainless steel, or other materials that can be manufactured by extrusion, injection molding, milling, or metal stamping, and the like.

In another embodiment, the gateway plate if made of stainless steel would have a thickness of about 0.018 inch.

Preferably, the gateway plate has a rounded lip edge to facilitate holding position between the slot cutout, and the inside roundness helps the sail-slug foot slide over the transition of the track edges.

Preferably the elastic coupling used is a shock cord, is 3/32-inch diameter, with the knots tied under the gate. Not required, but for added exterior protection of the shock cord, a tape or decal can be applied over the shock cord.

Preferably the elastic coupling would be made of weather resistant, elastic button 361 plugs with a pointed nipple that could be pulled through the spar and then through an interior mount gateway plate holes first, slide the gateway plate behind the slot so the pointed rubber nipples poke through the holes in the mast, and pull on nipple to fully seat the button rim. This way the button head sits flush on the exterior of the spar and the tail sits inside the spar channel and serves as a biasing means pushing the plate against the slot opening.

The present invention is particularly suited for use with masts and spars made of extruded aluminum with an integral track for a sail to be slidably affixed to the mast using sail-slugs secured and spaced along the luff edge of the sail, from the clew to the head of said sail.

An added advantage for booms that mount with a track slide: the boom will snap through the one-way gate; and by placing a slot-stop below the boom, the boom can be slid higher up the mast to create more headroom and/or create a tall boom tent.

The device according to the present invention allows installing the sail's clew-end sail-slug in through the one-way gateway plate first, and slide it down to the boom, and continue installing all of the sail-slugs till sail is flaked on top of the boom and secured. Then, the halyard may be attached to the head of the sail. The sail is ready for hoisting the sail-slugs past the gateway plate surface while maintaining smooth continuous contact up or down the sail track without spilling out.

The embodiments herein are directed to non-interference one-way sail slot gates and the gates herein can include a means for allowing one-way loading of the sail-slugs into the sail slot and mast track. This one-way loading can be described as breech loading or, alternatively, the means for a one-way loading can be described as a tube or splint gateway plate loading.

The various preferred embodiments of the present invention provide a means for a one-way sail slot gateway plate having an aperture, snapping closed each time a sail-slug or boom slide is fed into the sail slot and allows vertical bi-directional movement the sail track at any time, providing a Safer & Shorter setup time. And wherein the spar comprises a mast, a user can slide the slugs up and down in a vertical direction.

DRAWING

FIG. 16 is the system of FIG. 15 in a closed position.

FIG. 17 is an alternate view of the system of FIG. 15 in a closed position.

FIG. 18 is the system of FIG. 17 in an open position.

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

The conventional teaching in this art instructs a head-up method of attaching a sail into the mast. This requires precision control of the main halyard with one hand, slowly raising the head of the sail up, while the other hand aligns each sail slug, in its turn, into the sail slot track, till all is pulled up in progression before installing a track-stop device above the slot opening. This conventional method, however, is problematic. For example, sometimes while admiring a raised sail, a sailor may notice a sail slug waving for your attention to unload the sail and start over again. Or, when dropping a sail, the track-stop can dislodge and bounce overboard followed by the sail quickly spilling out of the mast. Or, sometimes in the staging area, while installing the mainsail, a gust of wind creates additional hazard as a raised sail may start flogging, boom swinging, and may shake the boat lose on the trailer. Further, the conventional track-stop device not only prevents a Mainsail from being lowered completely to the boom (below the track-stop), but will ends up creating a greater blind spot during docking in a crowded marina, creating added wind resistance, and makes reefing to the J-hook harder.

In contrast, the various embodiments of the present invention enable a sailor to load the sail slugs up or down the mast track. And by installing the sail downward, in reverse order, both hands are free to install sail slugs quicker, and the wind will never have the opportunity to catch an open sail. Further, a sailor will no longer have to unload the sail to insert a missed sail-slug, just drop sail to snap slug in. The present invention, in certain embodiments, is presently sold (being available for sale after the date of the corresponding provisional patent application in the U.S.A.) under the brand-name "Snap-Gate", available on the Internet at mastgates.com or snapgate.com, for example. Such devices according to the present invention enable a sailor to open a track path from the boom to the top, which also allows repositioning a sliding boom above the gateway plate for increased head room, or rigging a tall boom-tent for shade or rain protection while in port.

Spars

Figure 1:
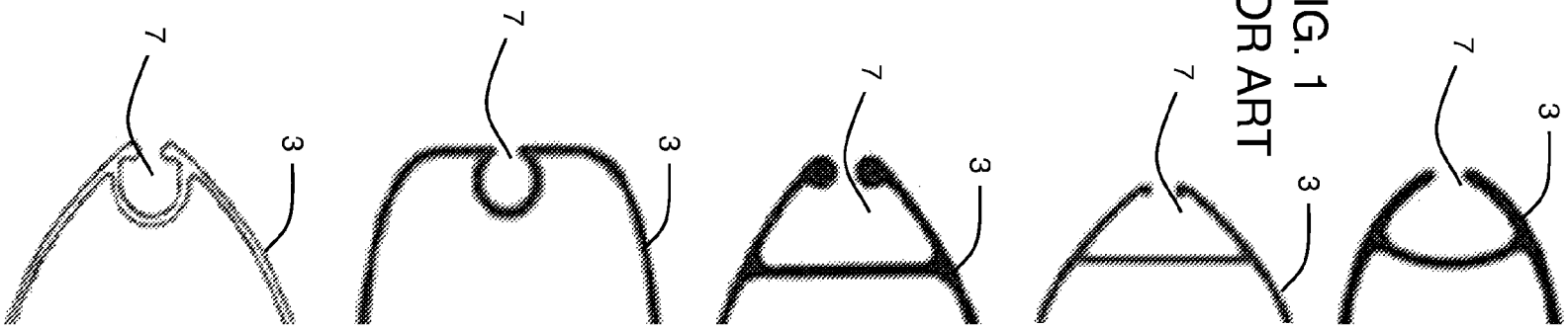
FIG. 1 PRIOR ART
FIG. 1 depicts conventional prior-art spars (masts) having an internal channel.
Figure 3:
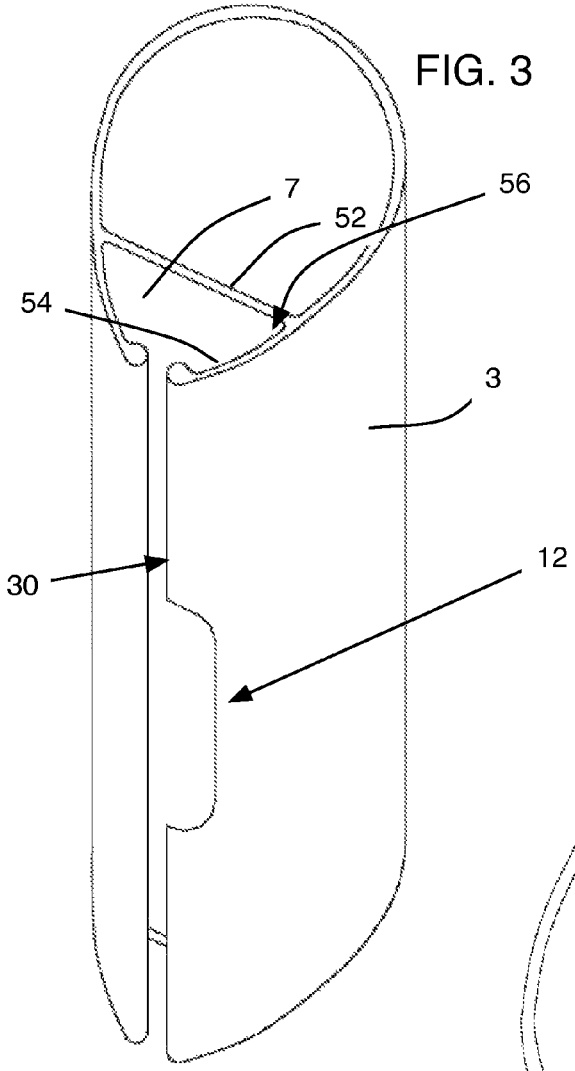
FIG. 3 is a partial offset frontal view of the spar of FIG. 2.

The present invention, in its various embodiments, readily adapts to work with many, if not all, known spar designs. Some common spar designs are depicted in FIG. 1. Such spars 3 include an internal channel 7. FIGS. 3 and 3A illustrate a conventional spar 3 with channel 7 and having been modified with a slot 12 to work with the present invention. This should not be deemed limiting, merely exemplary for better understanding the present invention.

Sail Slugs/Slides

Sail slugs, also called slides or slugs, are known in the conventional art. An example of such sail slugs includes those manufactured by Selden (available on the Internet at sailrite.com/SeldenMastSlidePlastic-5-8), for example and are available in many sizes including ½, 7/16-, and ⅜-inch. Such slides are used to secure mains or mizzens to their spars and make lowering sails easier. Sail slides are typically secured ahead of the boltrope and inserted in the mast slot instead of the rope. Secure this plastic slide to a sail with webbing, webbing and grommet, shackle and grommet, or just a shackle. Slugs and slides are generally installed every 26 inches along the luff edge and every 18 inches along the foot edge of a sail. Sail slides also keep the sail stacked in the slot when a sail track stop is used. Track stops are typically used with interior channel spars, also called internal mast grooves, and the specific design of a given track stop is particular to both the internal channel and the type of sail slug. Such track stops keep the sail and its slides in place on the mast above the slide entry gate. The track stop includes mounting hardware, such as a the knurled thumb screw and are typically made of heavy-duty, black anodized aluminum and marine grade nickel plated brass and come in varying styles and sizes. One such typical known track stop includes a "Track Stop Round" available on the Internet at sailrite.com/Sail-Track-Stop-Flat, and is described as a large knurled knob.

Gate Device

In the various preferred embodiments of the present invention, a gateway plate device 10 is described and can be configured for either external or internal mounting on a spar, such as a sailboat mast, having a channel. Sailboats include masts and other spars with internal channels, which are intended for a sail or other similar sheet-like panel, to insert by a line, rope, or other mechanical fastener, as will be further described herein.

Figure 2:
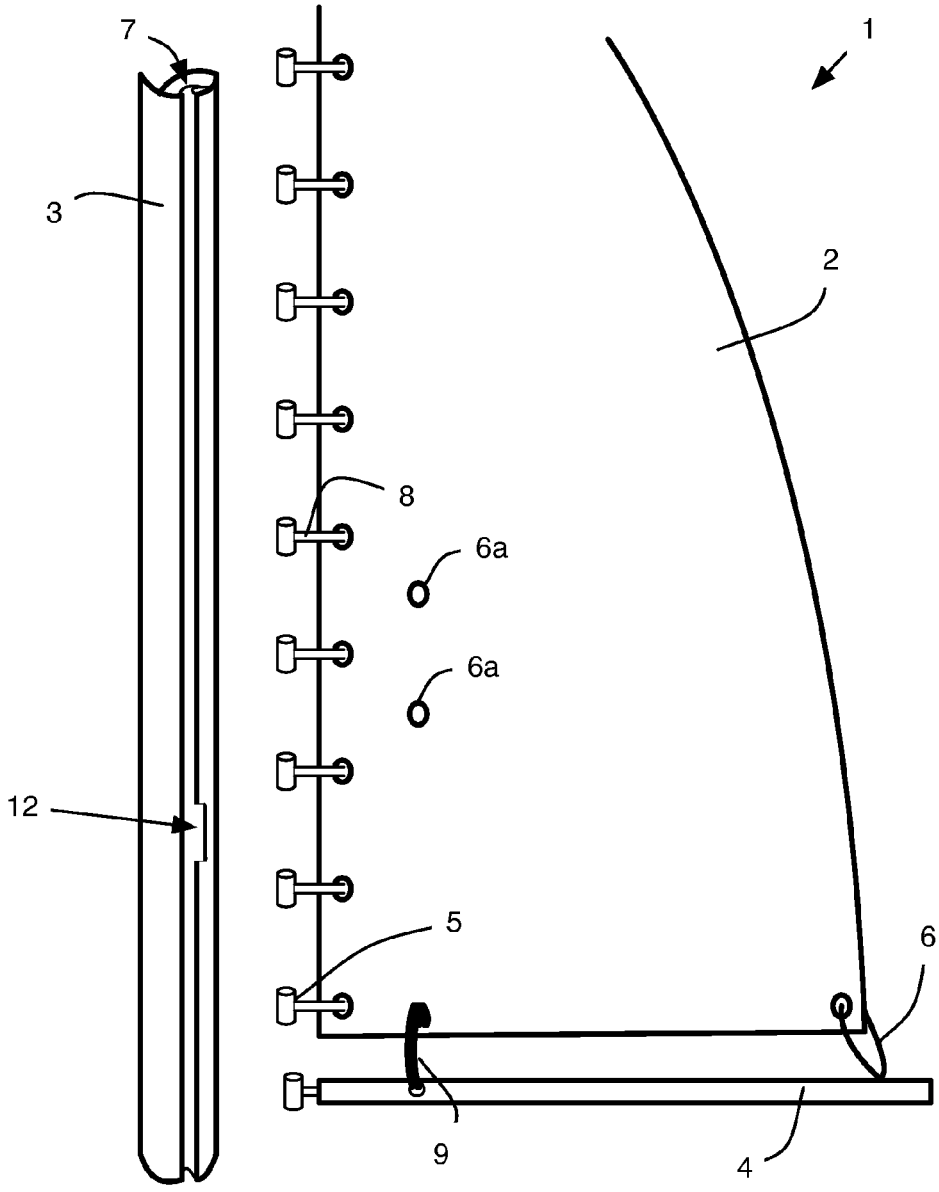
FIG. 2 illustrates a typical environment of use of preferred embodiments of the present invention and includes a conventional mast modified for use with the present invention.

The present invention includes an improved system 1 for rigging a sail 2 to a spar 3. FIG. 2 depicts a typical sail, and spar arrangement, well understood in the art, and includes a sail 2, boom 4, mast 3, j-hook 9, sail sliders/slugs 5, reefing cringles 6*a*, and rigging 6 (not shown are various lines, cords, and halyard, for example). The spar includes an internal channel member 7 extending a length of the spar. Typically, the spar, or mast, is made from extruded aluminum and the channel is integrated in the design of the mast so that the mast and channel are formed in one continues extrusion. The spar is adapted to slideably receive a plurality of sail slugs 5, each sail slug having a connecting member 8 for coupling to the sail, and this is typically a mechanical device or line, or cord and/or grommet, etc. as would be well-understood in the art. To enhance the biasing means of the elastic cord, during assembly of the gate to the spar a twist to each end of the cord (from one-half twist to a full twist at each end) plus a center knot 34*a* will better enable the cord to push the gate against the spar in the closed position and allow the plate body to snap open in the open position. A plastic retainer 35 at each end snugs the respective cord ends in the openings 14 and 16.

Figure 4:
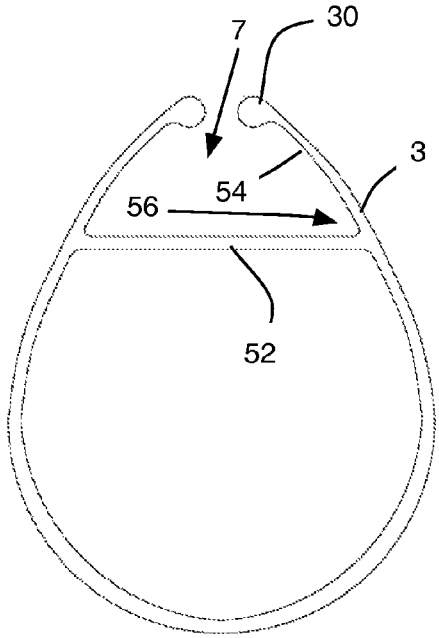
FIG. 4 is a cross section of the spar of FIG. 3.
Figure 5A:
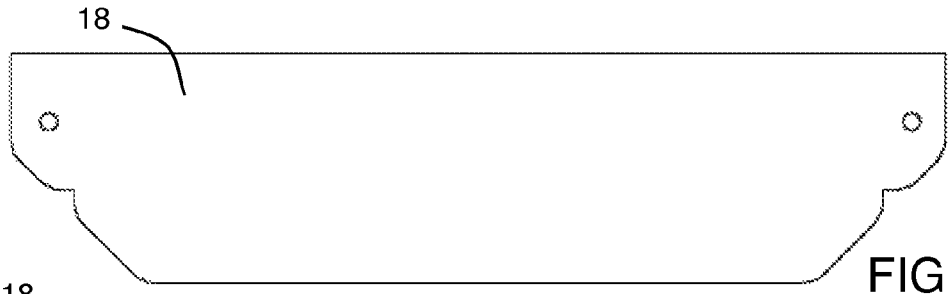
FIG. 5A is a top view of a template for one possible gateway plate prior to a bending or forming operation.
Figure 5B:
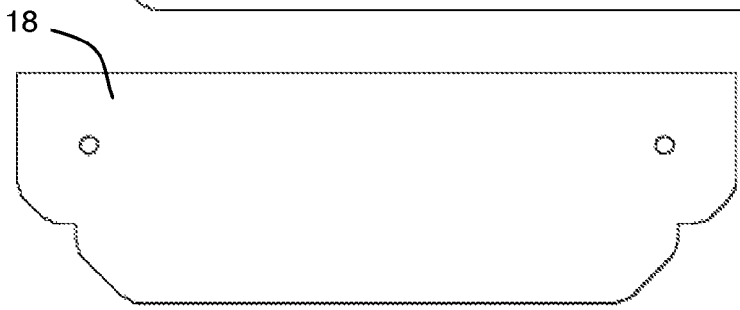
FIG. 5B is a top view of a template for one possible gateway plate prior to a bending or forming operation.
Figure 5C:
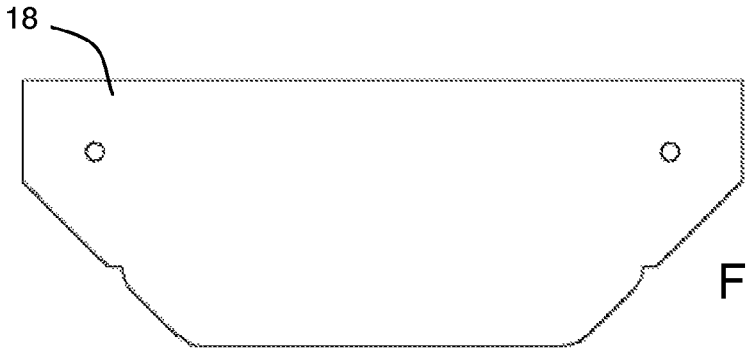
FIG. 5C is a top view of a template for one possible gateway plate prior to a bending or forming operation.
Figure 5D:
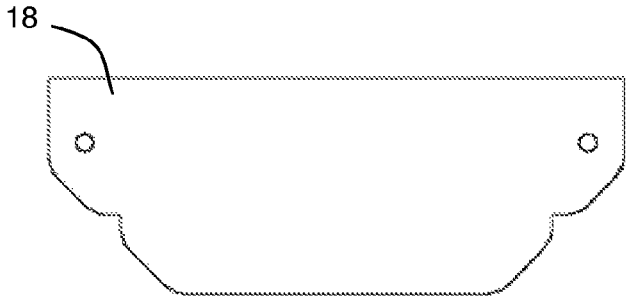
FIG. 5D is a top view of a template for one possible gateway plate prior to a bending or forming operation.
Figure 5E:
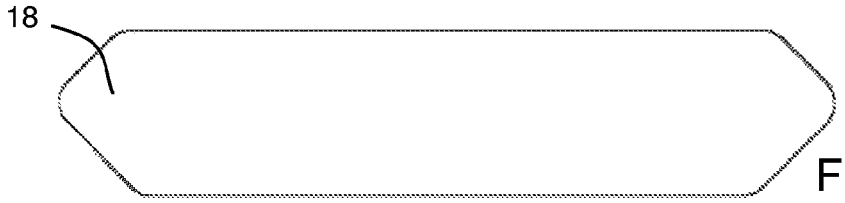
FIG. 5E is a top view of a template for one possible gateway plate prior to a bending or forming operation.
Figure 5F:
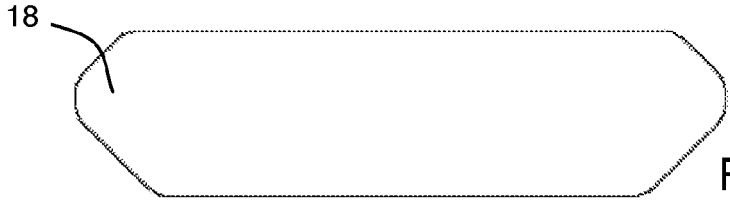
FIG. 5F is a top view of a template for one possible gateway plate prior to a bending or forming operation.
Figure 5G:
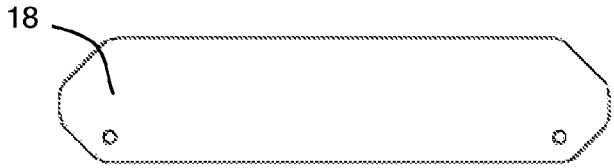
FIG. 5G is a top view of a template for one possible gateway plate prior to a bending or forming operation.
Figure 5H:
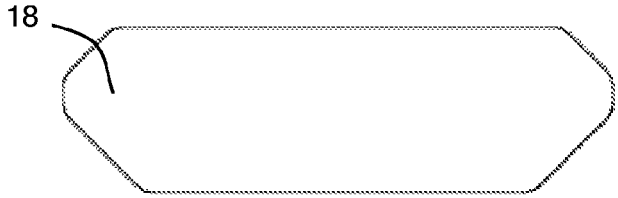
FIG. 5H is a top view of a template for one possible gateway plate prior to a bending or forming operation.
Figure 5I:
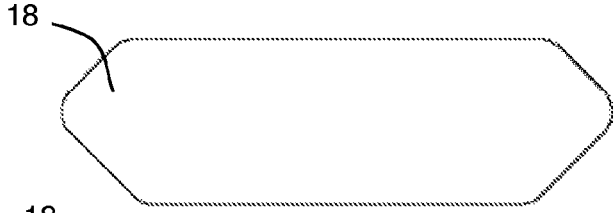
FIG. 5I is a top view of a template for one possible gateway plate prior to a bending or forming operation.
Figure 5J:
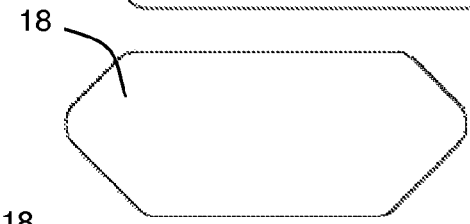
FIG. 5J is a top view of a template for one possible gateway plate prior to a bending or forming operation.
Figure 5K:
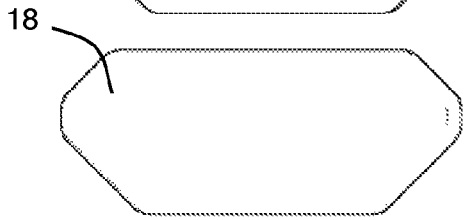
FIG. 5K is a top view of a template for one possible gateway plate prior to a bending or forming operation.
Figure 6:
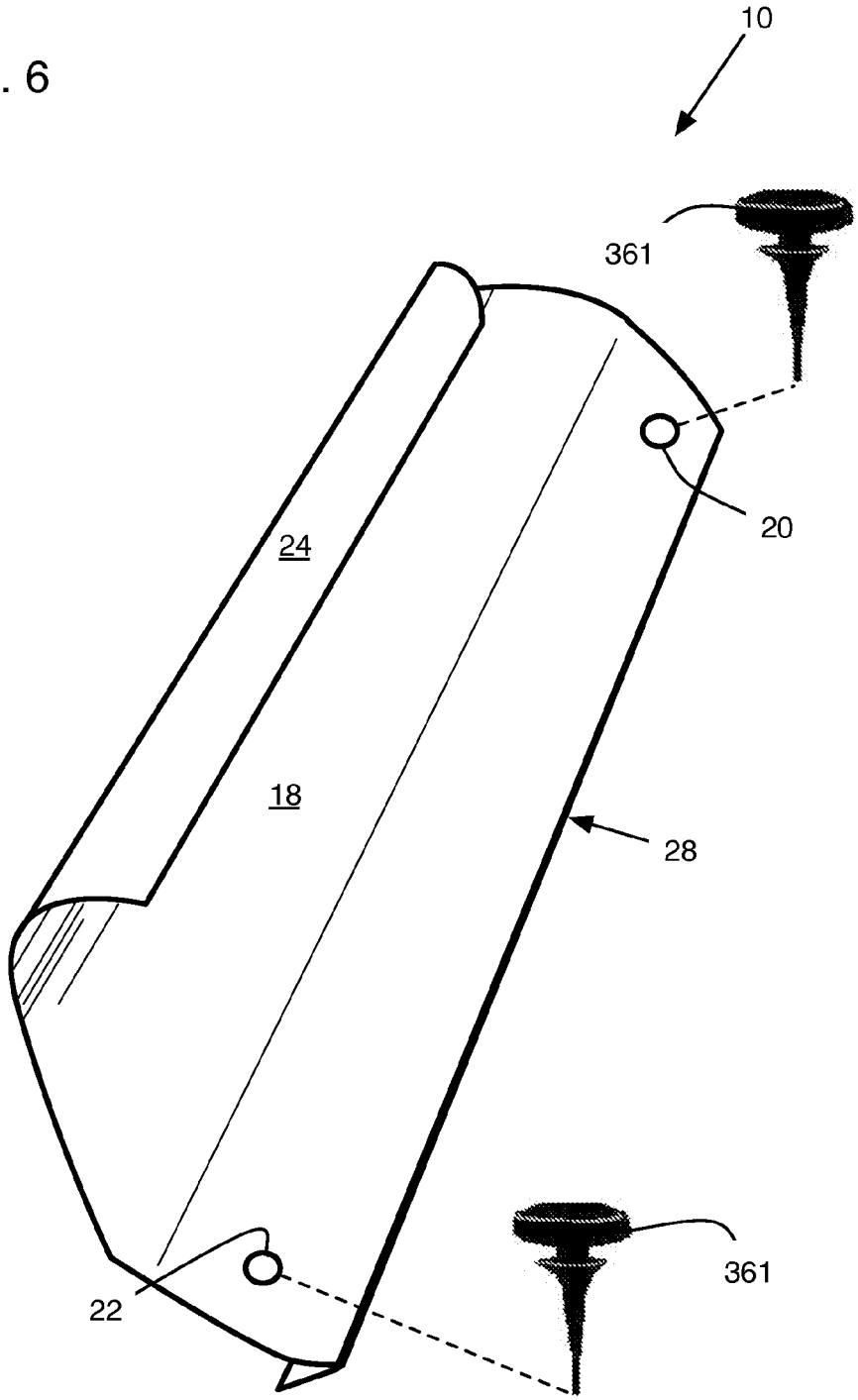
FIG. 6 is an off-set frontal view of an interior-mounted gateway plate according to one preferred embodiment of the present invention.
Figure 7:
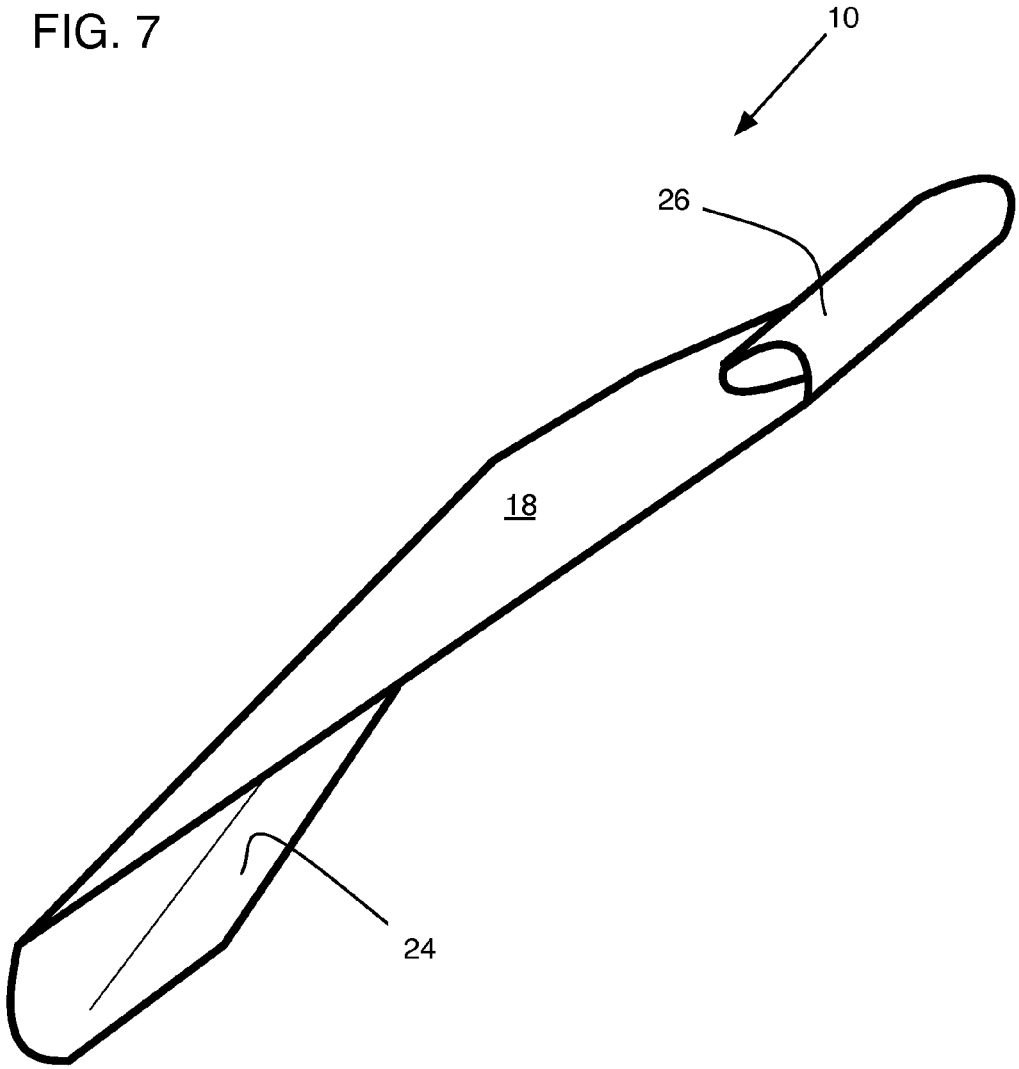
FIG. 7 is an off-set frontal view of an exterior mount gateway plate according to another preferred embodiment of the present invention.
Figure 8:
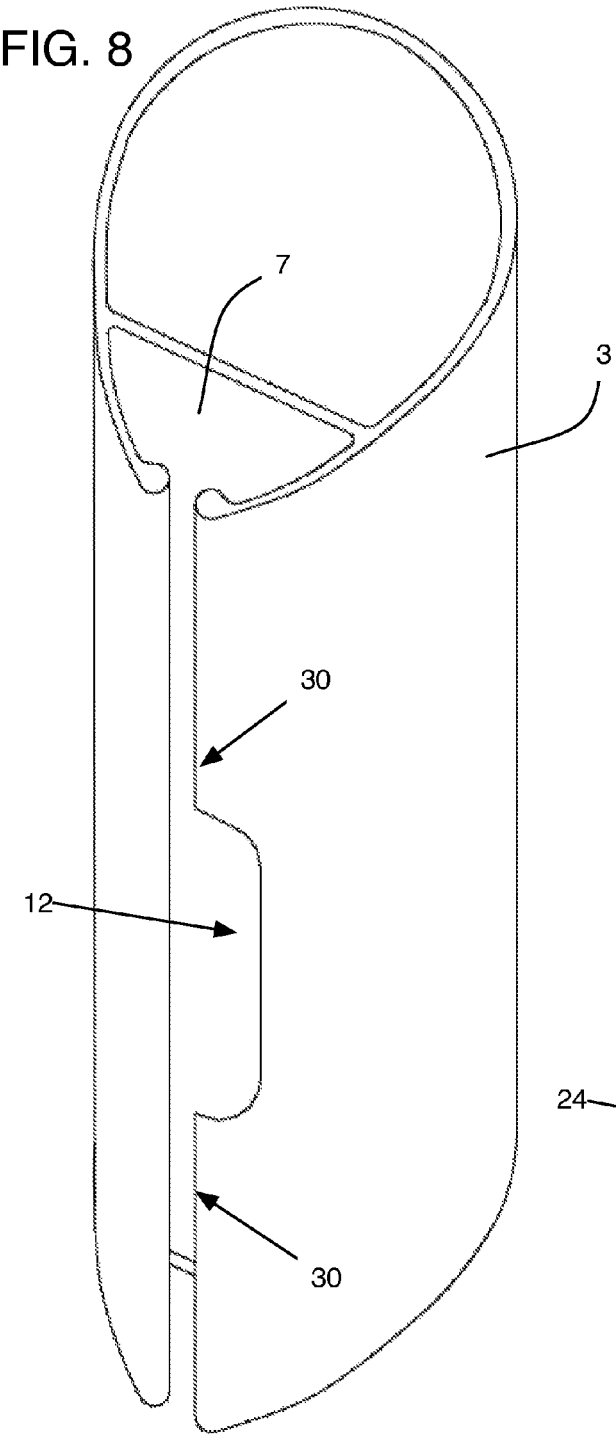
FIG. 8 is a partial off-set frontal exploded view of a certain components of a system according to the present invention and a conventional spar.
Figure 8A:
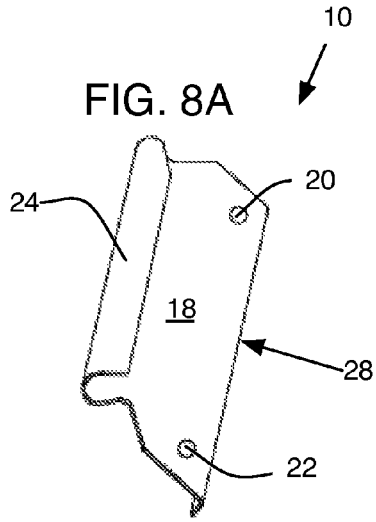
FIG. 8A is a front view of an interior mount gateway plate according to a preferred embodiment of the present invention.
Figure 8B:
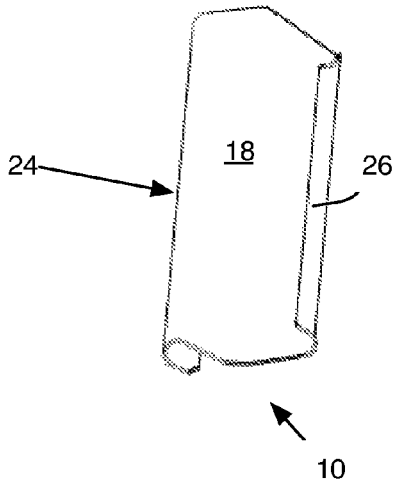
FIG. 8B is a front view of an exterior mount gateway plate.
Figure 9:
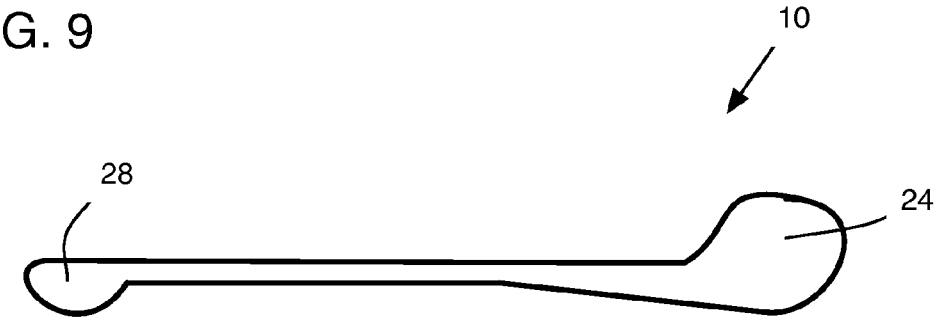
FIG. 9 is a side view of a gateway plate according to one embodiment of the present invention.
Figure 10:
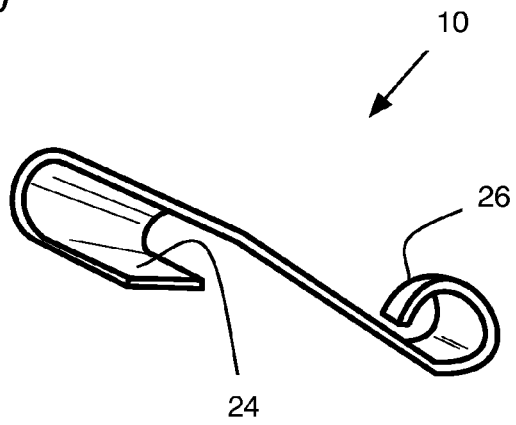
FIG. 10 is an offset frontal view of a gateway plate according to one embodiment of the present invention.

To better understand an interior mount gateway plate device, understanding various aspects of the channel 7 is helpful. The channel 7, as FIGS. 3 and 4 illustrate, includes a web 52 and at least one interior wall 54, which cooperate to form the channel. The apex 56 occurs at the intersection of the web and one interior wall. For interior mount gateway plate devices, the plate body has one end that arranges next to the interior wall along the apex (the plate body has a foot end 28 adjacent to the apex of the channel), which is used as the gateway plate's pivot axis. Accordingly, interior mount gateway plate bodies include an upturned flange or end that engages the apex.

Figure 11:
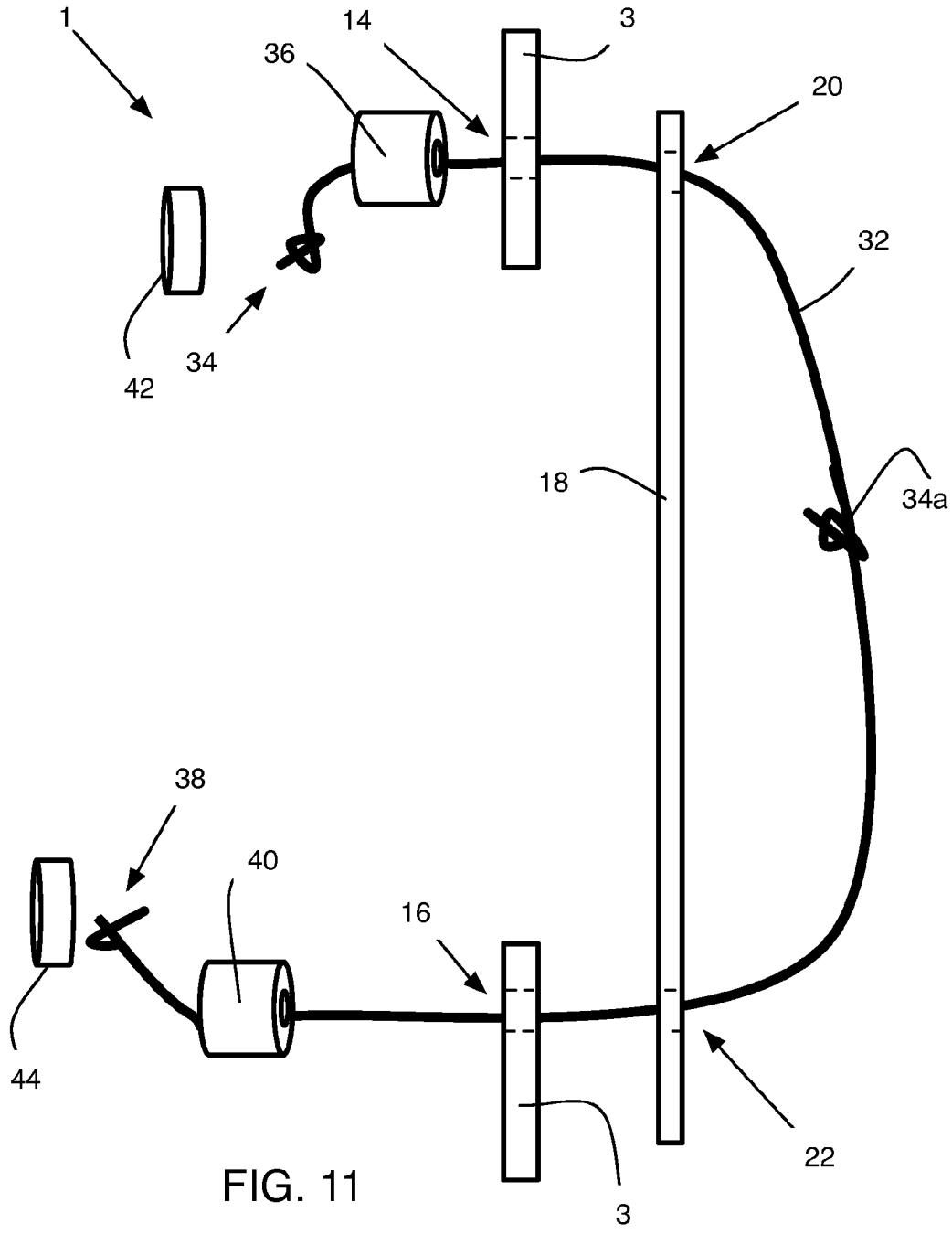
FIG. 11 is an exploded side view of various components of an interior mount gateway plate device according to one preferred embodiment of the present invention.

In its most fundamental form, as FIG. 11 illustrates, the improved system 1 includes a gateway plate 18 having two plate holes 20, 22, an elastic cord 32 and securing means at both ends of the cord. The securing means includes a knotted first end 34 and washer 36 (or other similar blocking device) and a similarly knotted second end 38 and second washer 40. The mast 3 includes a purposely configured slot and first 14 and second 16 receiving holes.

FIG. 11 further illustrates an interior mount gateway plate 10 of the present invention in relation to a slot opening on a spar (a portion of the spar 3 is shown in this sideview). The interior mount plate includes caps or washer 42 that cover an external knot 33 and 38 at each end of the shock cord elastic member 32. An intermediate knot 34*a* is included for safety: That is, it prevents the cord from dislodging in the event that one of the end knots comes undone. And further, in a preferred embodiment the foot consists of a 1/10-inch bend at the base edge (foot end 28), this provides a means for width adjustment of the gateway plate 10 by using pliers to bend two small tabs down which lifts plate up, for example.

Figure 15:
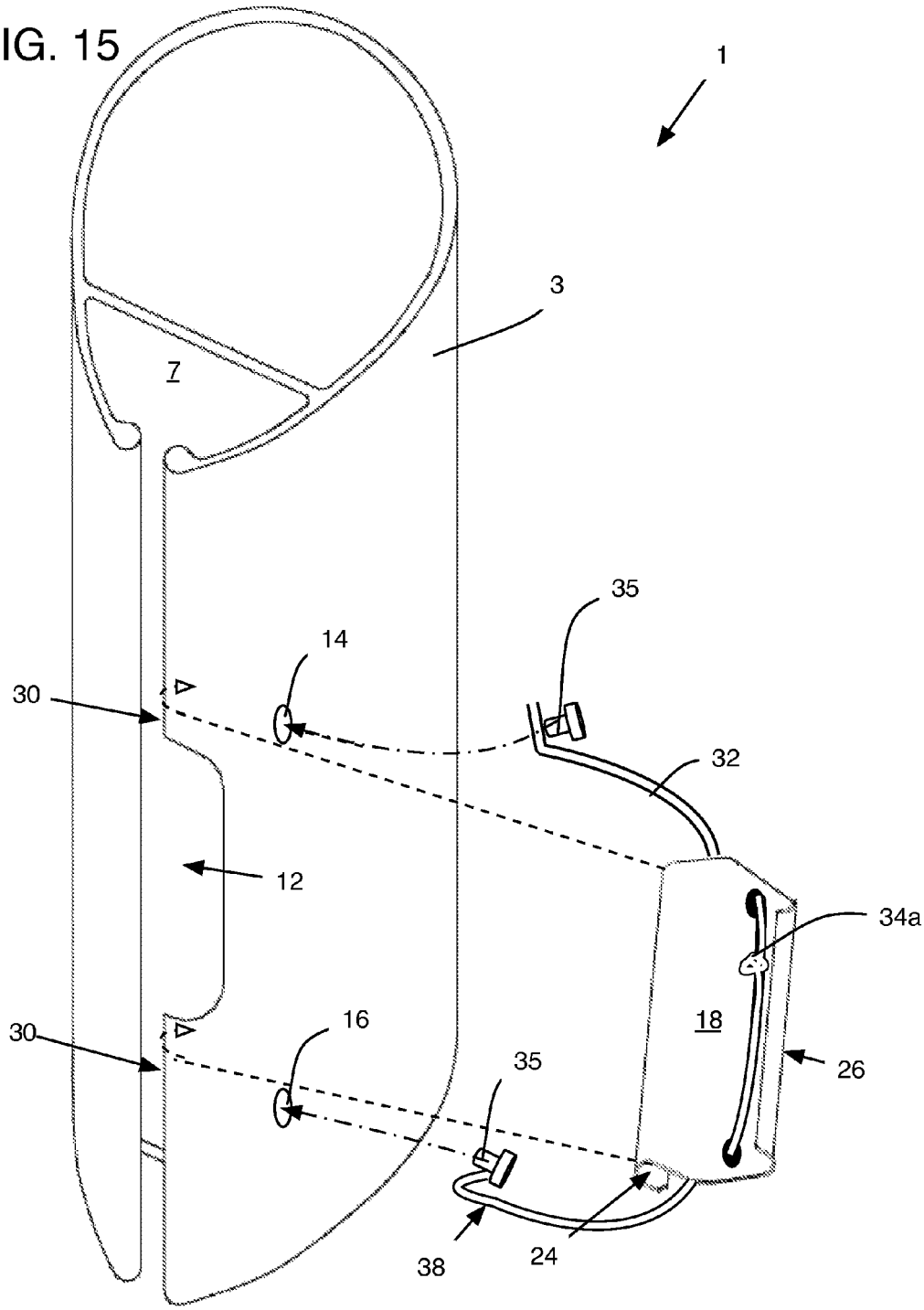
FIG. 15 is an exploded off-set frontal view showing various components of the gateway plate device according to a preferred embodiment of the present invention.

FIG. 15 better illustrates this improved system 1 according to one preferred embodiment of the present invention. The improved system 1, therefore, comprises: A slot 12 disposed on a portion of the spar 3 to selectively enable at least one of the plurality of sail slugs to engage a portion of the internal channel 7, a first 14 and second 16 receiving hole disposed on the spar at a predetermined receiving-hole distance, and this distance is further described in the method of installation section, below.

This system further comprises: An external mount gateway plate 10 adapted to selectively cover the slot 12 and be removed from the slot whereby when positioned to cover the slot at least one of the plurality of sail slugs remains slideably in the channel and when positioned to be removed from the slot at least one of the plurality of sail slugs may selectively be removed from the channel. The gateway plate device 10 comprises a gateway plate body 18 comprising a first 20 and second 22 oppositely disposed plate-hole, the plate holes (20, 22) having a predetermined alignment with the receiving-holes on the spar (as discussed subsequently herein). The gateway plate 18 further comprises a channel-engaging edge 24 and an oppositely disposed handle end 26. The channel engaging edge locates the plate body relative to the slot, and mimics the channel profile inside the spar to enable the sail slugs to effortlessly slide over the plate body when in the closed position. The handle end enables a sailor to unhood the gate end from the spar to allow the plate body to snap open. The handle end further encapsulates a portion of the elastic member to keep it in proper position and further covers the center knot 34*a* in the cord.

This system further comprises: A biasing means comprising a predetermined length of elastic cord 32. One such suitable elastic cord is a "shock cord". For example, for use with an exterior-mount gate, an 8-inch to about 12-inch length of 3/32" shock cord from American Power Cord Corp. However, any good quality elastic band member with good tension and little pull, plus UV & weather & abrasion resistant polyester jacket (suitable for marine use), with an elastic core (for example, natural latex rubber) would work equally well. And, for an interior-mount gate, an 8-inch to about a 12-inch length of 3/32-inch shock cord from "DaleHollowOutdors.com", Part# 1000717903 or any other similar elastic cord that exhibits good flexibility to tie a small knot on ends and press into Snap-Caps, and one that has UV & weather & abrasion resistant polyester jacket with an elastic core, such as natural latex rubber, would work equally well.

Other flexible materials can be used instead of an elastic cord (shock cord), for example, flexible metals used in eyeglasses, that can be twisted and spring back to original shape, which would be like a torsion bar in another design of this invention.

The elastic cord includes a first end 34 securing to the spar—for example a knotted end with an optional dollop of silicon glue. This first end extends through the first receiving hole 14 and a first washer 36, and first plate hole 20. The elastic cord also has a second end 38 securing to the spar, the second end extending through the second plate hole 22, second washer 40 and second receiving hole 16, and secures to the spar.

FIGS. 16, 17, and 18 illustrate this exterior mount gateway plate body 18 on a spar. FIGS. 16 and 17 show the gateway plate in a closed position. The plate body 18 is retained by means of the elastic cord 32, which passes through the spar receiving holes 14 and 16 and is held in place by a plastic retainer 35. The leading edge 4 wraps around a slot edge on the spar when closed. When open, as FIG. 18 shows, the plate body 18 rests against an exterior surface of the spar, with the leading edge exposed 24 and not engated to the spar edge.

The interior mount plate body 18 includes an upturned foot 28. The foot provides stability to the relatively flat plate 18, ensures that the plate lie flat against the apex of the channel (defined between the channel web and at least one sidewall) of the spar. However, the foot 28 can not be used and is not needed when a pivoting apex is too acute for a foot to seat smoothly into. A sharp angle apex serves well to hold a flat edged gate.

The exterior mount system further comprises: A first cap 42 disposed over the first washer 36 and adapted to secure the first washer and first cord end in the first receiving hole 14; and a second cap 44 disposed over the second washer 40 and adapted to secure the second washer and second cord end in the second receiving hole 16. Suitable caps include, for example: For an exterior gateway plate plastic retainers to attach the shock cord to mast, holding exterior gate, such as an "Auveco.com", part# 11120, for GM 1967 automotive weather strip retainer, which is available at least from Parkrose Ave Hardware store, Vancouver, Wash. And, for interior-mount gates, caps available from Pro-Dec.com such as a Snap-Cap washer: plastic cup shape with ⅛" hole, Part #: 8/8-FB, or other Snap-Cap plastic cup shape caps made of plastic with different colors, and selection of electroplating in gold; chrome; and satin finishes, would also work.

Figure 14:
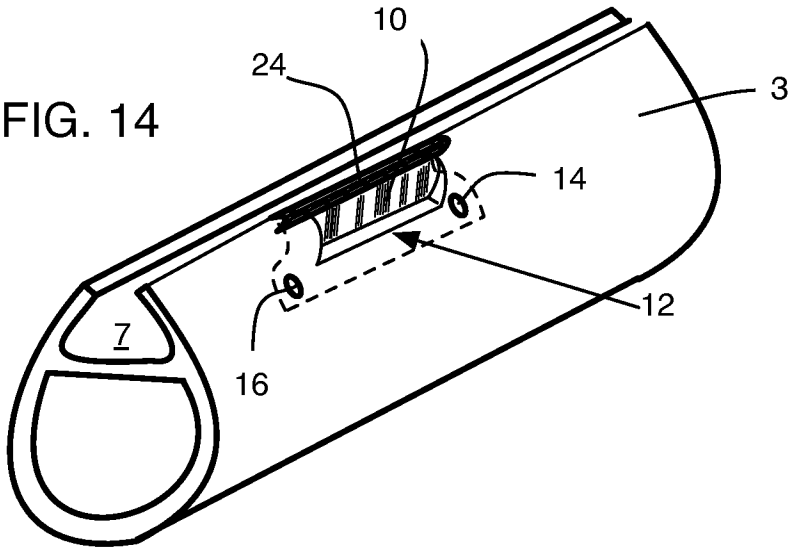
FIG. 14 illustrates the plate of FIG. 12 on an inside channel of a spar.
Figure 13:
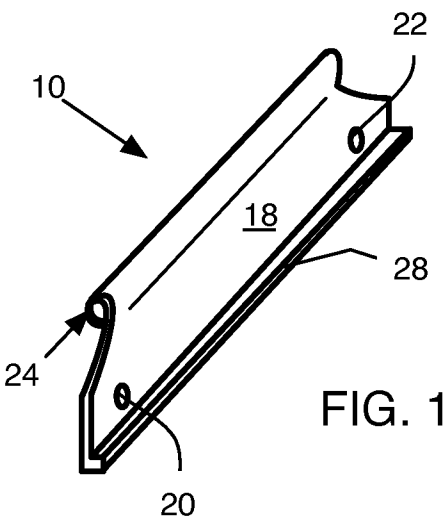
FIG. 13 is an offset back view of the gateway plate of FIG. 12.
Figure 12:
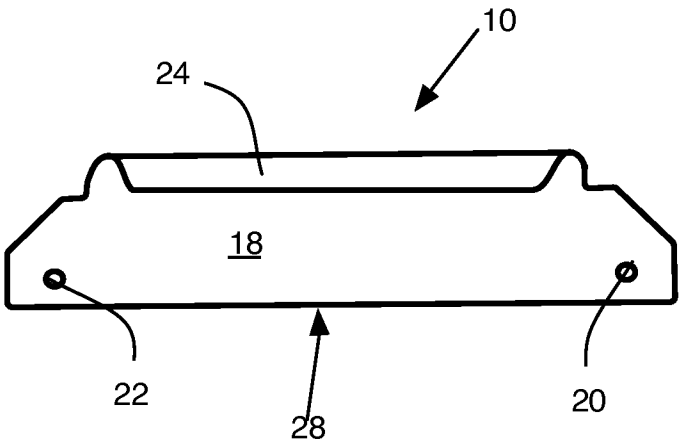
FIG. 12 is a front view of an interior mount gateway plate according to yet another preferred embodiment of the present invention.
Figures 19, 20:
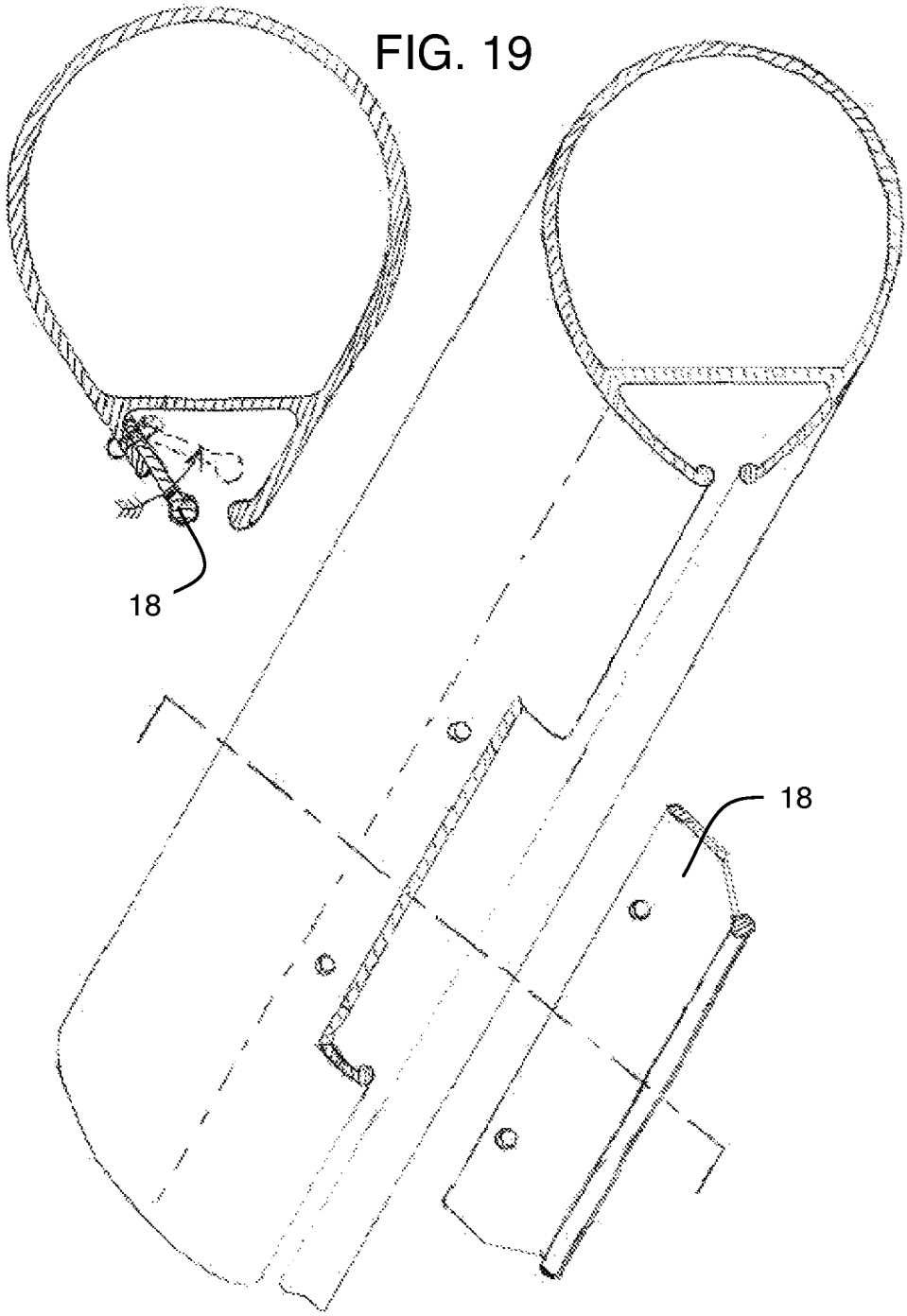
FIG. 19 is top view of an interior mount system according to one embodiment of the present invention.
FIG. 20 is a front view of the system of FIG. 19.

FIGS. 14, 19 and 20 illustrate an internal mount gateway plate 10 (the gate, for example, of FIG. 12 and FIG. 13). Again, a mast or spar 3 includes an internal channel 7. A slot 12 is made in the spar and two receiving holes 14, 16, are drilled into the spar. The gateway plate 10 comprises a plate body 18 having a turned channel edge 24 that wraps around the plate body to emulate the channel edge 30. The plate body 18 covers the slot (when in the gateway plate 10 is in the closed position). The gateway plate 10, as FIGS. 12 and 13 better illustrate, includes a foot 28; this provides stability and acts as a hinging member to the relatively flat plate 18. The gateway plate 10 includes two plate holes 20, 22 for enabling an elastic cord (not shown) to pass through.

A feature to prevent or reduce sail slugs from jamming in track at the Track to gateway plate transition. The head of the plate is cut with a sinusoidal bias that guides the sail-slug away from the gateway plate plate's edge, to the center of the track opening.

Kit

A common way of kitting the present invention to provide a more convenient self-installation set of components include providing, unassembled: a gateway plate with a template pre-adhered to the plate, a predetermined length of shock cord, at least two snap cap washer, at least two snap caps, and a predetermined length of one-sided tape.

Installation Method

A preferred method of installing a gateway plate device of the present invention includes the following steps:

First, locate the position of and drill two holes in the existing mast. The object of a successful installation when drilling two holes in the mast, serve two functions: A) To hold the Snap-Gate Plate centered in sail slot; and B) To have the drilled mast holes slightly offset from gateway plate holes (by about 1/32-inch), so the shock cord will pull the gateway plate into mast.

Second, the do-it-yourself sailor should provide the following tools: an automatic center punch, a small hand file, a drill and assorted drill bits including a 1/16-inch bit and a ⅛-inch bit, silicon glue (optional), tape, a measuring device or template (a business card works great), and a length of string. Additionally, a needle-nose pliers or a curved hemostat may be handy, but are not mandatory.

Third, test how well the gateway plate sits behind the mast sail slot, by just using your fingers to hold it. If there are any interferences for a central lose fit, or the gateway plate plate's track to align with the mast track, use your file to fine-tune the gateway plate and/or the sail slot and mast track bead.

Fourth, place the measuring device, ideally the business card, into the track behind the sail slot and tape top of card to mast. Then, insert the gateway plate between the card and slot cutout. (The card holds the plate inside the track).

Fifth, center the gateway plate in the sail slot and firmly pull the paper template over the gateway plate and the mast track, then tape the template to the mast and center-punch the center of the template holes.

Sixth, remove all items from mast and drill two 1/16-inch pilot holes, then drill ⅛-inch holes and use the file to remove any burrs around the holes or sail slot aperture. Caution: If re-drilling of the holes is required, a vertical offset will cause the gateway plate to not center in the slot. A fore and aft offset will effect how well the gateway plate is pushed or pulled into the track slot. And, a 1/32-inch offset is all that is needed for proper alignment of the gate.

Seventh, using your hand, hold the gateway plate in the sail slot. When looking through one of the mast holes (bottom-most hole) you will see the bottom half of the gateway plate hole. This slight offset causes the gateway plate to be pulled into correct alignment in the track.

Eighth, thread the long end of shock cord into the mast, through the gateway plate (laying outside mast). After one end is through the plate, add a center knot **34*a*** to the shock cord. Use the length of string to use as a small line and loop that line through mast hole to snag and pull cord through.

Ninth, pull the shock cord snug while sliding the gateway plate into the track (to remove kinks in the cord) then relax the shock cord. Finally, drop a snap cap washer over cord end, and apply only slight tension on the shock cord when tying a lose over-hand knot. Don't cut end off till after rechecking fit. Beware: If the knot is pulled too small, add drop of silicon glue, to keep knot from pulling through Cap washers. Tuck about ¼-inch of cord tail into the washer then press the snap cap on.

Where to Place a Sail Slot

When retrofitting an existing spar, such as a mast, for the gateway plate device of the present invention, it is important to allow sufficient space to fully flake the sail under the gateway plate. The sail slot (in the spar or mast) should be located between two sail slides (sail slugs) (See FIG. 2). When cutting the sail slot, consideration should be made as to which side of the spar to cut. Being right or left-handed will influence which side of the mast is cut. Most right-handed persons prefer sitting or standing on the starboard (right) side of the mast when installing the boom and sail slides, so the cut would also be on the starboard side.

With the side of the spar to cut selected, use a drafting compass, or adjustable square to scribe a ⅜ inch distance to mark the depth limit of the cut on the side of the mast track you prefer to load the sail from. Then, slide the metal tip of compass against the track lip while the pencil marks the vertical boundary. Mark the top and bottom limits using the head of the gateway plate to mark the opening slot limits, and If possible, make a 45-degree dove-tail cuts instead of 90-degree cut (dove tail cuts, and curved cuts provide more support and strength for the gateway plate and reduce stress on the mast, so such cuts are preferred).

Although the invention has been particularly shown and described with reference to certain embodiments, it will be understood by those skilled in the art that various changes in form and detail may be made without departing from the spirit and scope of the invention.

I claim:

1. An improved system for rigging a sail to a spar having an internal channel member extending a length of the spar, the spar adapted to slideably receive a plurality of sail slugs, each sail slug having a connecting member for coupling to the sail; the improvement comprising:

a slot disposed on a portion of the spar to selectively enable at least one of the plurality of sail slugs to engage a portion of the internal channel, first and second receiving holes disposed on the spar at a predetermined receiving-hole distance;

a gateway plate adapted to selectively cover the slot and be removed from the slot whereby when positioned to cover the slot at least one of the plurality of sail slugs remains slideaby in the channel and when positioned to be removed from the slot at least one of the plurality of sail slugs may selectively be removed from the channel, the gateway plate comprising a gateway plate body comprising first and second oppositely disposed plate-holes, the plate holes having a predetermined alignment with the receiving-holes on the spar, the gateway plate body further comprising a channel-engaging edge; and a biasing means comprising a predetermined length of elastic cord having a first end securing to the spar, the first end extending through the first receiving hole and the first plate hole, and the elastic cord having a second end securing to the spar, the second end extending through the second plate hole and the second receiving hole, the second cord end securing to the spar.

2. The improved system of claim 1 further comprising:

a first washer disposed in the first receiving hole;

a second washer disposed in the second receiving hole; and wherein the elastic cord extends through each respective washer.

3. The improved system of claim 2 further comprising:

a first cap disposed over the first washer and adapted to secure the first washer and the first cord end in the first receiving hole; and a second cap disposed over the second washer and adapted to secure the second washer and the second cord end in the second receiving hole.

4. The gateway plate device of claim 1 further comprising:

a foot member arranged opposite the channel engaging end, the foot member adapted to hingeably engage a portion of the channel of the spar whereby the plate body arranges as an interior mount to the spar.

5. The gateway plate device of claim 1 comprising:

a handle member arranged opposite the channel engaging end, the handle member adapted to cover a portion of the biasing means and whereby the plate body arranges as an exterior mount to the spar.

* * * * *